US009028086B2

(12) United States Patent
Woo et al.

(10) Patent No.: US 9,028,086 B2
(45) Date of Patent: May 12, 2015

(54) LIGHT SOURCE FOR ILLUMINATION APPARATUS AND METHOD OF MANUFACTURING THE SAME

(75) Inventors: Yun Seok Woo, Gyeonggi-do (KR); Won Hoe Koo, Seoul (KR); Jin Woo Bae, Seoul (KR); Wuk Chul Joung, Daejeon (KR); Chang Hoon Baek, Gyeonggi-do (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 613 days.

(21) Appl. No.: 13/310,410

(22) Filed: Dec. 2, 2011

(65) Prior Publication Data

US 2012/0140442 A1 Jun. 7, 2012

(30) Foreign Application Priority Data

Dec. 3, 2010 (KR) ..... 10-2010-0123041

(51) Int. Cl.

| | |
|---|---|
| ***F21V 33/00*** | (2006.01) |
| ***F21V 23/00*** | (2006.01) |
| ***F21K 99/00*** | (2010.01) |
| ***F21V 7/04*** | (2006.01) |
| ***F21V 7/09*** | (2006.01) |
| ***F21V 15/01*** | (2006.01) |
| ***F21V 19/00*** | (2006.01) |

(Continued)

(52) U.S. Cl.

CPC ..... *F21V 23/006* (2013.01); *F21K 9/30* (2013.01); *F21S 2/005* (2013.01); *F21V 7/04* (2013.01); *F21V 7/09* (2013.01); *F21V 15/01* (2013.01); *F21V 19/006* (2013.01); *F21V 29/22* (2013.01); *F21Y 2101/02* (2013.01); *F21Y 2105/001* (2013.01)

(58) Field of Classification Search

USPC ..... 362/373, 294, 249.02, 362, 364, 365, 362/655, 649

See application file for complete search history.

(56) References Cited

U.S. PATENT DOCUMENTS

| | | | | |
|---|---|---|---|---|
| 2009/0175037 | A1 | 7/2009 | Ewert | |
| 2010/0302768 | A1 | 12/2010 | Collins et al. | |
| 2011/0261572 | A1 * | 10/2011 | Watanabe et al. | 362/373 |

FOREIGN PATENT DOCUMENTS

| | | | |
|---|---|---|---|
| CN | 2851827 | Y | 12/2006 |
| EP | 2 336 631 | A1 | 6/2011 |

(Continued)

OTHER PUBLICATIONS

Chinese Office Action with English translation issued in Chinese Application No. 201110400236.0 issued on Dec. 18, 2013.

(Continued)

*Primary Examiner* — Joseph L Williams

(74) *Attorney, Agent, or Firm* — McDermott Will & Emery LLP

(57) ABSTRACT

There is provided a light source for an illumination apparatus and a method of manufacturing the same. The light source includes a light emitting device; a power unit module supplying an electrical signal to the light emitting device; a support unit having the light emitting device thereon and discharging heat generated by the light emitting device to the outside; and a housing unit covering and protecting the light emitting device, the power unit module and the support unit. The light emitting device is disposed to have a height greater than that of a contact region between the power unit module and the housing unit with relation to a lower edge of the housing unit.

25 Claims, 13 Drawing Sheets

(51) Int. Cl.

| | |
|---|---|
| *F21S 2/00* | (2006.01) |
| *F21V 29/00* | (2006.01) |
| *F21Y 101/02* | (2006.01) |
| *F21Y 105/00* | (2006.01) |

(56) References Cited

FOREIGN PATENT DOCUMENTS

| | | |
|---|---|---|
| JP | 2010-123369 | 6/2010 |
| JP | 2010-129491 | 6/2010 |
| JP | 2010-157377 A | 7/2010 |

OTHER PUBLICATIONS

Extended European Search Report issued in European Application No. 11191840.5 issued on Nov. 29, 2013.

Chinese Office Action issued in Chinese Application No. 201110400236.0 dated Aug. 26, 2014, with English Translation.

* cited by examiner

LIGHT SOURCE FOR ILLUMINATION APPARATUS AND METHOD OF MANUFACTURING THE SAME

CROSS-REFERENCE TO RELATED APPLICATIONS

This application claims the priority of Korean Patent Application No. 10-2010-0123041 filed on Dec. 3, 2010, in the Korean Intellectual Property Office, the disclosure of which is incorporated herein by reference.

BACKGROUND OF THE INVENTION

1. Field of the Invention

The present invention relates to a light source for an illumination apparatus and a method of manufacturing the same.

2. Description of the Related Art

A light emitting diode (LED) is a semiconductor device capable of emitting light of various colors through changes in compound semiconductor materials such as GaAs, AlGaAs, GaN, InGaP and the like when included in a light emitting source.

Since LEDs have superior monochromic peak wavelengths and improved light emission efficiency as well as being miniaturizable, environmentally-friendly and low in power consumption, they are widely being used in various applications such as TVs, computers, illumination apparatuses, vehicles and the like. Furthermore, the applications of LEDs are gradually being extended.

An illumination apparatus using LEDs as a light source has a longer life span than that of an existing incandescent lamp or halogen lamp, thereby drawing a great deal of attention.

However, LEDs generate a large amount of heat as current levels applied thereto are increased. Such heat may cause a reduction in light emission efficiency and life span.

In order to maintain a long life span, it is necessary to study the structure of an illumination apparatus able to maximize thermal emission and improve light emission efficiency. To enable this, research into the standardization of a structure in which the coupling and separation of a light source and an illumination apparatus are facilitated, in addition to having an improved structure of a light source for an illumination apparatus allowing for enhanced thermal emission and light emission efficiency, has been actively carried out.

SUMMARY OF THE INVENTION

An aspect of the present invention provides a light source for an illumination apparatus having a simplified structure and enhanced thermal emission and light emission efficiency to thereby be improved in terms of lifespan and product reliability, and a method of manufacturing the same.

According to an aspect of the present invention, there is provided a light source for an illumination apparatus, the light source including: a light emitting device; a power unit module supplying an electrical signal to the light emitting device; a support unit having the light emitting device thereon and discharging heat generated by the light emitting device to the outside; and a housing unit covering and protecting the light emitting device, the power unit module and the support unit, wherein the light emitting device is disposed to have a height greater than that of a contact region between the power unit module and the housing unit with relation to a lower edge of the housing unit.

The power unit module may include a circuit board and electronic devices mounted on the circuit board, and the circuit board may have a through hole in a central portion thereof.

The power unit module may include a terminal portion provided on an outer circumferential surface of the circuit board to be supplied with an electrical signal, and the terminal portion may protrude outwardly of the housing unit.

The electronic devices may be disposed about a circumference of the through hole.

The support unit may include a mounting portion having the light emitting device mounted thereon and disposed to protrude upwardly of the circuit board through the through hole such that the height of the light emitting device is adjustable with relation to the lower edge of the housing unit.

The support unit may support the light emitting device mounted on the mounting portion to be disposed in a central portion of the power unit module.

The mounting portion may be disposed to have a height in a range of ⅓ to ⅗ of a height of the housing unit with relation to the lower edge of the housing unit.

The support unit may include a plurality of protruding portions provided along an outer circumferential surface thereof, and the plurality of protruding portions may protrude outwardly of the housing unit.

The light source may further include an insulating adapter disposed between the power unit module and the support unit.

The insulating adapter may include an accommodating portion including an accommodating groove having the circuit board placed therein; and an insertion portion disposed in a central portion of the accommodating portion to protrude upwardly of the circuit board through the through hole and including an insertion hole having the support unit inserted thereinto.

The housing unit may include a body having a space accommodating the light emitting device, the power unit module and the support unit therein; and a reflective surface extending from an upper edge of the body towards the space and providing an opening allowing the light emitting device to be exposed.

The reflective surface may include a first surface slantly extending from the upper edge of the body to be inclined at a first angle of inclination with relation to an optical axis perpendicular to the light emitting device; and a second surface slantly extending from an edge of the first surface to be bent at a second angle of inclination with relation to the optical axis.

The first angle of inclination with relation to the optical axis may be in a range of 47° to 70°, and the second angle of inclination with relation to the optical axis may be in a range of 1° to 62°.

A ratio of the first angle of inclination to the second angle of inclination may be in a range of 1 to 70.

The housing unit may further include a diffusion plate mounted on the upper edge of the body; and a covering portion fixing the diffusion plate.

The covering portion may have a plurality of coupling protrusions on an upper surface thereof.

The plurality of coupling protrusions may include part of the plurality of coupling protrusions disposed along an inner circumferential surface of the covering portion to be spaced apart from adjacent coupling protrusions; and the other part thereof disposed along an outer circumferential surface of the covering portion to be spaced apart from adjacent coupling protrusions, wherein the individual coupling protrusions disposed along the outer circumferential surface of the covering portion alternate with the individual coupling protrusions disposed along the inner circumferential surface of the covering portion to be arranged in a series of zigzags.

The light source may further include a socket having a coupling hole detachably coupled with the housing unit inserted therein and supplying the electrical signal from the outside to the light emitting device.

The socket may include guide grooves extending from an upper edge of the coupling hole towards a lower edge thereof; and fixing grooves connected to the guide grooves and provided along an inner circumferential surface of the coupling hole.

The light source may further include a reflective shade provided about a circumference of the housing unit.

The light source may further include a heat sink discharging heat generated by the light emitting device and the power unit module to the outside.

According to another aspect of the present invention, there is provided a light source for an illumination apparatus, the light source including a light emitting device mounted on a board; a power unit module supplying an electrical signal to the light emitting device; a support unit having the light emitting device thereon and discharging heat generated by the light emitting device to the outside; and a housing unit covering and protecting the light emitting device, the power unit module and the support unit, wherein the board is separated and spaced apart from a circuit board of the power unit module to be disposed above the circuit board.

The power unit module may include the circuit board and electronic devices mounted on the circuit board, and the circuit board may have a through hole in a central portion thereof.

The support unit may include a mounting portion having the light emitting device mounted thereon and disposed to protrude upwardly of the circuit board through the through hole such that a height of the light emitting device is adjustable with relation to a lower edge of the housing unit.

The mounting portion may be disposed to have a height in a range of ⅓ to ⅗ of a height of the housing unit with relation to the lower edge of the housing unit.

The housing unit may include a body having a space accommodating the light emitting device, the power unit module and the support unit therein; and a reflective surface extending from an upper edge of the body towards the space and providing an opening allowing the light emitting device to be exposed.

The reflective surface may include a first surface slantly extending from the upper edge of the body to be inclined at a first angle of inclination with relation to an optical axis perpendicular to the light emitting device; and a second surface slantly extending from an edge of the first surface to be bent at a second angle of inclination with relation to the optical axis.

The first angle of inclination with relation to the optical axis may be in a range of 47° to 70°, and the second angle of inclination with relation to the optical axis may be in a range of 1° to 62°.

A ratio of the first angle of inclination to the second angle of inclination may be in a range of 1 to 70.

According to another aspect of the present invention, there is provided a method of manufacturing a light source for an illumination apparatus, the method including: preparing a power unit module having electronic devices provided on a circuit board having a through hole; preparing an insulating adapter including an accommodating portion having an accommodating groove, in which the circuit board is placed, and an insertion portion protruding upwardly of the accommodating portion and having an insertion hole; preparing a support unit having a mounting portion inserted into the insertion hole; assembling the insulating adapter and the support unit with the power unit module by causing the mounting portion inserted into the insertion hole, together with the insertion portion, to be protruded upwardly of the circuit board through the through hole; mounting the light emitting device on the mounting portion so as to be disposed above the circuit board to be spaced apart therefrom; and preparing a housing unit including a body having a space accommodating an assembly, in which the power unit module, the insulating adapter and the support unit having the light emitting device mounted thereon are assembled, therein and a reflective surface disposed within the space, and allowing the assembly to be coupled to and accommodated within the space through an open lower edge of the body.

The mounting portion may be disposed to have a height in a range of ⅓ to ⅗ of a height of the housing unit with relation to a lower edge of the housing unit.

The reflective surface may include a first surface slantly extending from an upper edge of the body to be inclined at a first angle of inclination with relation to an optical axis; and a second surface slantly extending from an edge of the first surface to be bent at a second angle of inclination with relation to the optical axis.

The first angle of inclination with relation to the optical axis may be in a range of 47° to 70°, and the second angle of inclination with relation to the optical axis may be in a range of 1° to 62°.

A ratio of the first angle of inclination to the second angle of inclination may be in a range of 1 to 70.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1:
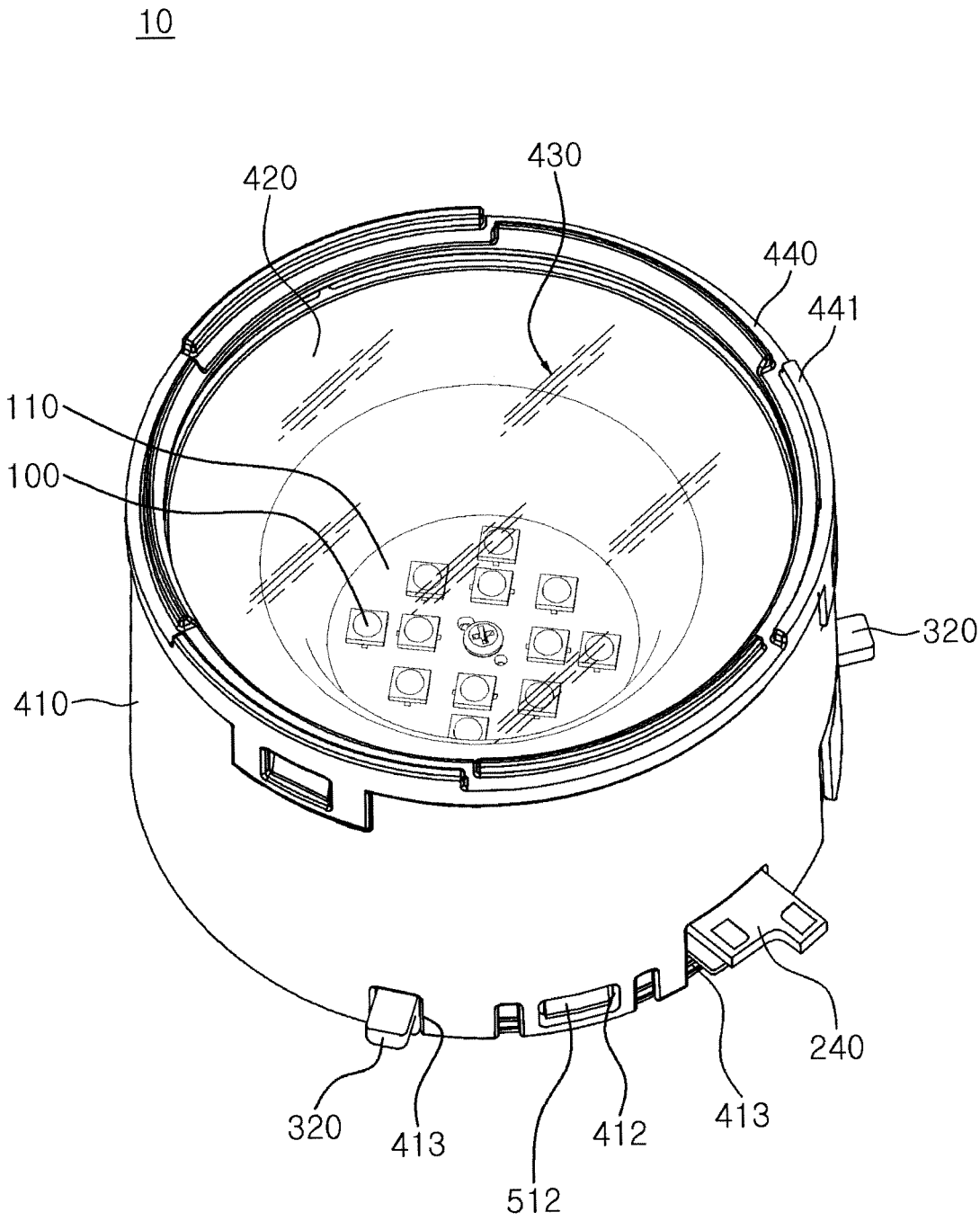
FIG. 1 is a schematic perspective view of a light source for an illumination apparatus according to an embodiment of the present invention.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art.

In the drawings, the shapes and dimensions of elements may be exaggerated for clarity, and the same reference numerals will be used throughout to designate the same or like elements.

A light source for an illumination apparatus according to an embodiment of the invention will be described with reference to FIGS. 1 through 7.

Figure 2:
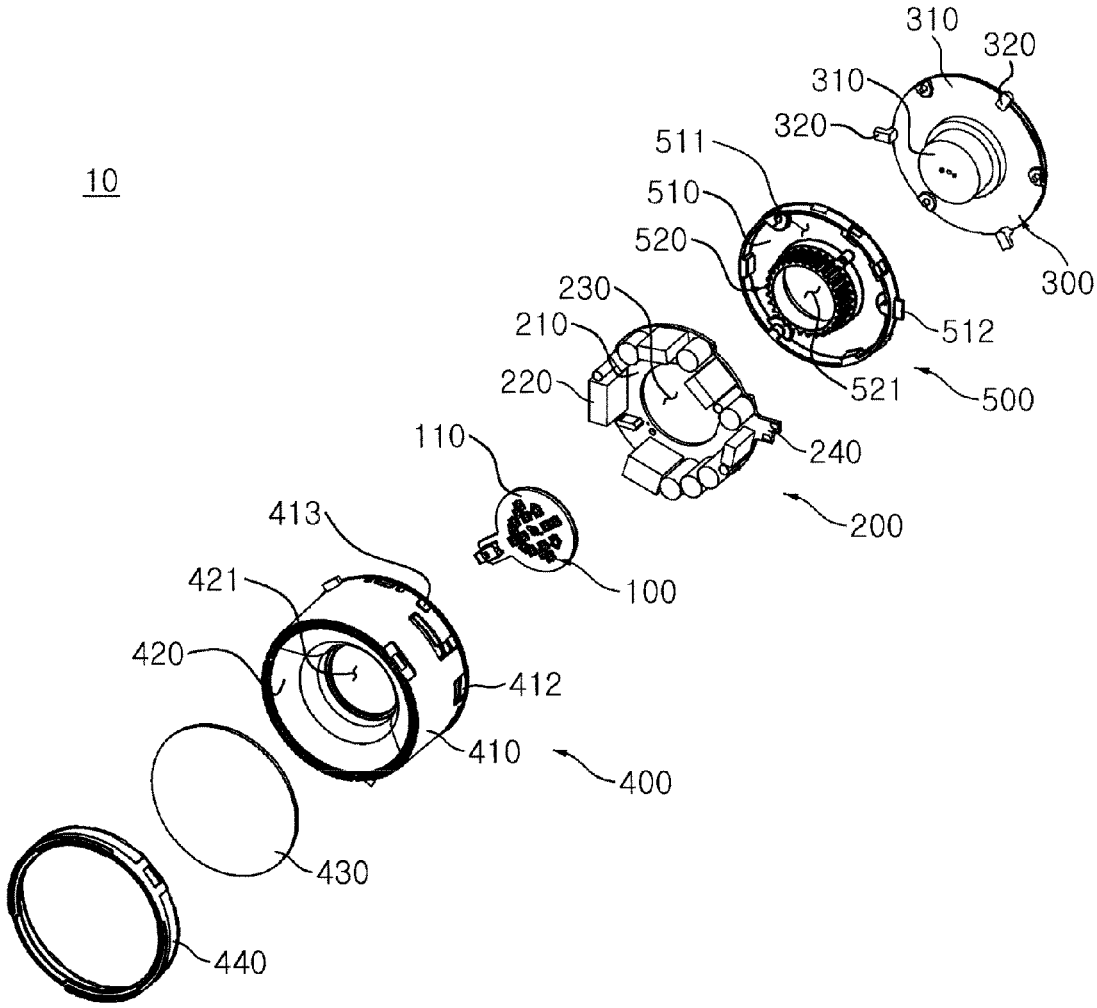
FIG. 2 is an exploded perspective view of the light source for an illumination apparatus of FIG. 1.

As shown in FIGS. 1 and 2, a light source 10 for an illumination apparatus according to an embodiment of the invention includes a light emitting device 100, a power unit module 200, a support unit 300 and a housing unit 400. The light source 10 may further include an insulating adapter 500 provided between the power unit module 200 and the support unit 300.

The insulating adapter 500, the power unit module 200 and the light emitting device 100 are sequentially stacked on the support unit 300 to form an assembly, and the housing unit 400 is coupled to the assembly through a lower edge thereof such that the housing unit 500 covers the assembly. A diffusion plate 430 for the diffusion of light emitted from the light emitting device 100 and a covering portion 440 for the fixation of the diffusion plate 430 are coupled to an upper edge of the housing unit 400.

Hereinafter, individual elements will be described in detail with reference to FIGS. 1 through 7.

The light emitting device 100 may include a light emitting diode (LED) chip or an LED package having LED chips mounted therein as an example of a semiconductor device emitting light having a predetermined wavelength due to an electrical signal applied from the outside. In the accompanying drawings, the LED package is illustrated as the light emitting device 100; however, the invention is not limited thereto. The LED chip may have a larger size than a general LED chip or may be a high output LED chip having improved light emission efficiency. Also, the light emitting device 100 may include a plurality of LED chips or a multi-chip package (MCP) having a plurality of LED chips mounted therein.

A board 110 may be a printed circuit board (PCB). The board 110 may be formed of an organic resin material containing epoxy resin, triazine resin, silicone resin, polyimide resin, or the like, other organic resin materials, a ceramic material such as AlN, $Al_2O_3$ or the like, or metals and metallic compounds. Specifically, in consideration of thermal emissions, the board 110 may be a metal core printed circuit board (MCPCB), one type of metal PCB.

The board 110, on which the light emitting device 100 is mounted, may include a circuit wiring (not shown) electrically connected to the light emitting device 100 and an insulating layer (not shown) having high withstand voltage.

The power unit module 200 may convert an electrical signal applied from the outside, particularly, AC power into DC power, to thereby allow the light emitting device 100 to operate. The circuit configuration of the power unit module 200 for driving the light emitting device 100 will be described below with reference to FIGS. 11 and 12.

Figure 3:
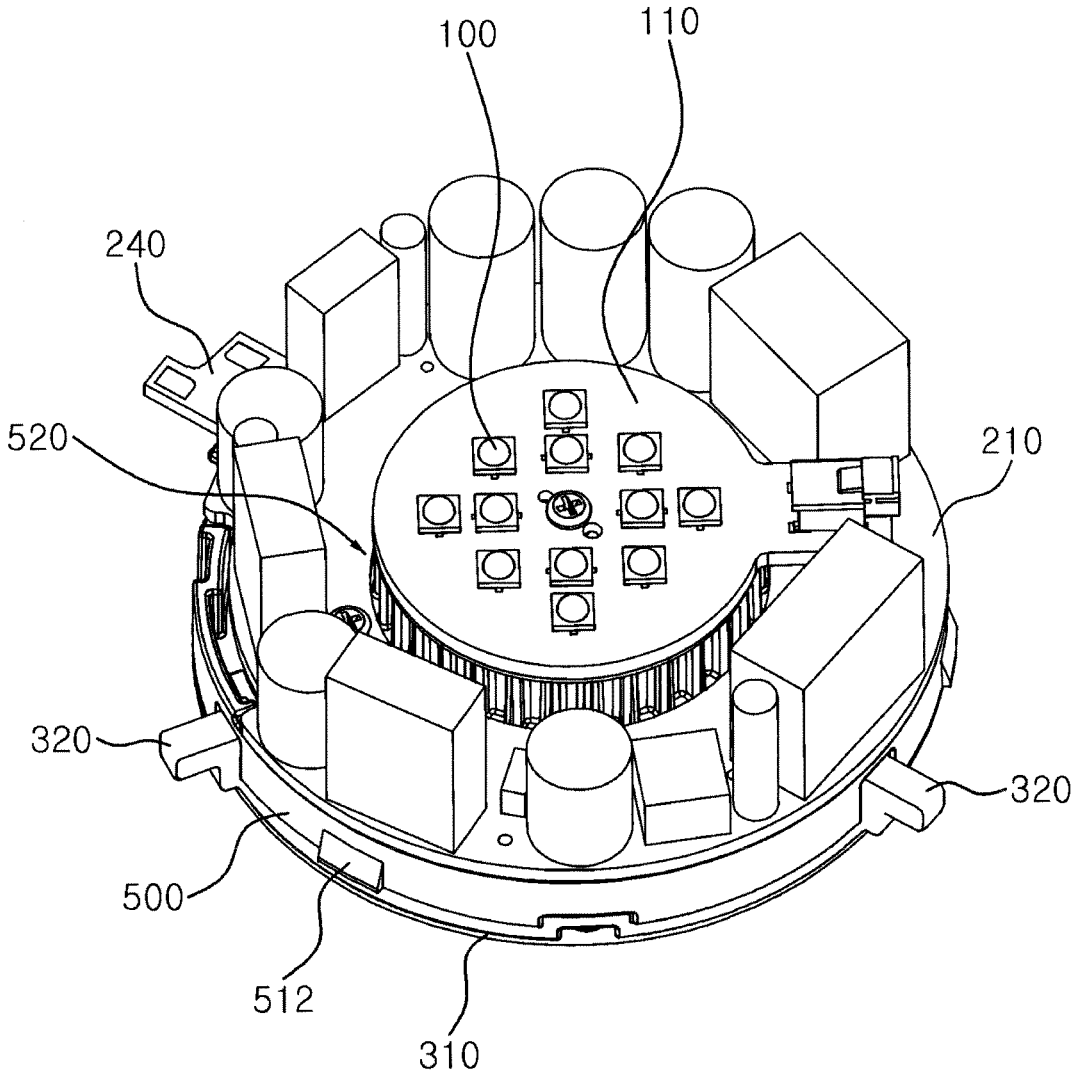
FIG. 3 is a schematic perspective view illustrating the coupling of a power unit module, an insulating adapter, a support unit and a light emitting device in the light source for an illumination apparatus of FIG. 2.

As shown in FIGS. 2 and 3, the power unit module 200 may include a circuit board 210 and a plurality of electronic devices 220 mounted on the circuit board 210, and may be disposed about the circumference of the light emitting device 100 to thereby enclose the light emitting device 100. Specifically, the circuit board 210 may have a through hole 230 in a central portion thereof, and the plurality of electronic devices 220 may be disposed on a portion of the circuit board 210 along the circumference of the through hole 230. The light emitting device 100 may be separated from the power unit module 200, and when disposed above the through hole 230, the light emitting device 100 may have a varied height above the circuit board 210.

The circuit board 210 may be a printed circuit board (PCB). The circuit board 210 may be formed of an organic resin material containing epoxy resin, triazine resin, silicone resin, polyimide resin, or the like, or other organic resin materials. For example, FR-4 or CEM may be used therefor.

The circuit board 210, in addition to the board 110, may be separately employed as shown in FIGS. 2 and 3. That is, only the light emitting device 100 may be mounted on the board 110 and only the electronic devices 220 may be mounted on the circuit board 210. The board 110 may be separated and spaced apart from the circuit board 210 to be disposed above the circuit board 210. Accordingly, the light emitting device 100 may be disposed to have a height greater than that of the circuit board 210 with relation to the lower edge of the housing unit 400, and the height of the light emitting device 100 may be adjustable. In such a structure in which two boards are used for the mounting of the light emitting device and the electronic devices, instead a single board being used therefor as in the related art, in a case in which a defect occurs in one of the elements, only the defective element is required to be replaced, whereby repair and maintenance may be facilitated. For example, in the case that the electronic devices 220 are defective, only the electronic devices 220 along with the circuit board 210 are replaced while the light emitting device 100 is retained. Furthermore, since the board 110 may be formed of a metal PCB, unlike the circuit board 210 formed of FR4 or CEM, the board 110 may be superior in terms of thermal emission efficiency as compared with a single board (formed of FR4 or CEM) according to the related art. In addition, since the height of the light emitting device 100 is adjustable, light output may be increased as will be described below.

The electronic device 220 may include a driving circuit device supplying power to the light emitting device 100 and controlling the driving of the light emitting device 100. Specifically, the electronic device 220 may include an EMI filter 201, an AC-DC converter 202, a DC-DC converter 203 and the like, thereby allowing the light emitting device 100 to be driven by commercial AC power supplied from the outside. The power unit module 200 may include a terminal portion 240 provided on an outer circumferential surface of the circuit board 210 so as to be supplied with electrical signals from the outside. The terminal portion 240 may protrude outwardly of an outer side surface of the housing unit 400 as shown in FIG. 1.

As shown in FIGS. 2 and 3, the support unit 300 supports the light emitting device 100 to be disposed in a central portion of the power unit module 200 and allows heat generated by the light emitting device 100 to be emitted outwardly. The support unit 300 has a shape corresponding to that of the circuit board 210 and is disposed on a lower surface of the circuit board 210. The support unit 300 has a mounting portion 310 in a central portion thereof, the mounting portion 310 protruding upwardly of the circuit board 210 by a predetermined height through the through hole 230. The light emitting device 100 is mounted on an upper surface of the mounting portion 310.

Accordingly, the light emitting device 100 mounted on the mounting portion 310 is disposed to have a height greater than that of the circuit board 210 with relation to the lower edge of the housing unit 400 according to the height of the mounting portion 310. The height of the light emitting device, particularly, the height of the mounting portion 310 protruding upwardly by penetrating through the circuit board 210 may be adjustable in consideration of the size, height or the like of the electronic devices 220 of the power unit module 200 disposed about the circumference of the light emitting device 100 such that the light output of the light emitting device 100 mounted on the mounting portion 310 may be increased. This will be described in detail below.

The support unit 300 may include a plurality of protruding portions 320 disposed around an outer circumferential surface thereof. The protruding portions 320 protrude outwardly of the outer side surface of the housing unit 400. The protruding portions 320 serve as locking members for coupling with a socket to be described below. In FIGS. 2 and 3, three protruding portions are provided; however, the invention is not limited thereto. The support unit 300 may be formed of metals and plastic for radiating heat so as to allow heat generated by the light emitting device 100 to be efficiently emitted to the outside.

The insulating adapter 500 may be disposed between the power unit module 200 and the support unit 300 as shown in FIGS. 2 and 3, to allow the power unit module 200 and the support unit 300 to be electrically insulated. The insulating adapter 500 may include an accommodating portion 510 having an accommodating groove 511 in which the circuit board 210 is placed, and an insertion portion 520 disposed in a central portion of the accommodating portion 510 to protrude upwardly of the circuit board 210 through the through hole 230 and including an insertion hole 521 having the mounting portion 310 inserted thereinto.

The height of the insertion portion 520 may correspond to that of the mounting portion 310, and the size and shape of the insertion hole 521 may correspond to those of the mounting portion 310. The mounting portion 310 of the support unit 300 inserted into the insertion hole 521 of the insertion portion 520 may be protruded by the same height as that of the insertion portion 520 with relation to the circuit board 210, and the light emitting device 100 may be stably mounted on the mounting portion 310 and the insertion portion 520.

In this manner, the insulating adapter 500 may ensure an insulating distance between the power unit module 200 and the support unit 300 and prevent electric shorts between the power unit module 200 and the light emitting device 100.

Figure 4:
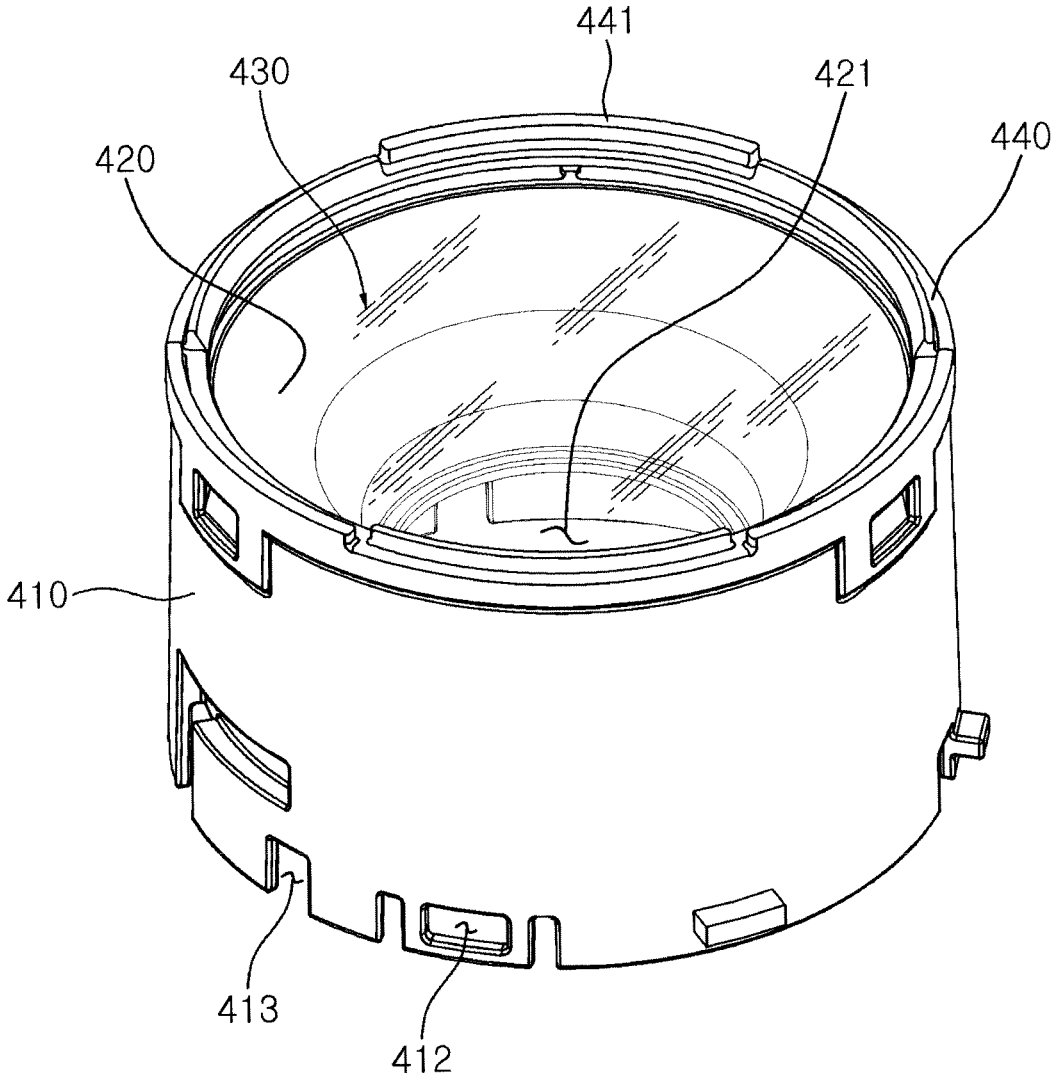
FIG. 4 is a schematic view of a housing unit in the light source for an illumination apparatus of FIG. 2.
Figure 5A:
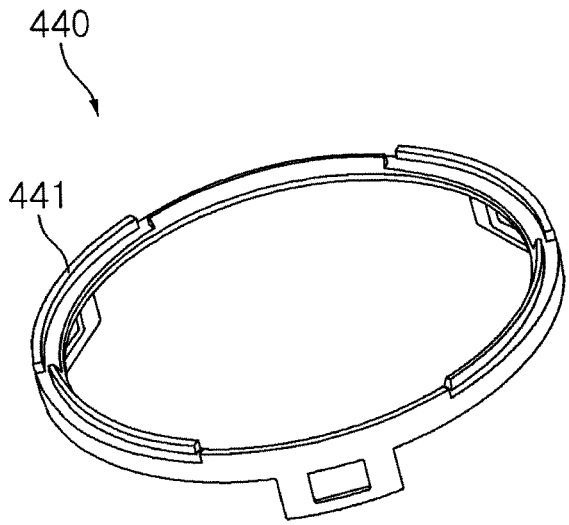
FIGS. 5A and 5B are schematic views of a covering portion provided in the light source for an illumination apparatus of FIG. 2.
Figure 5B:
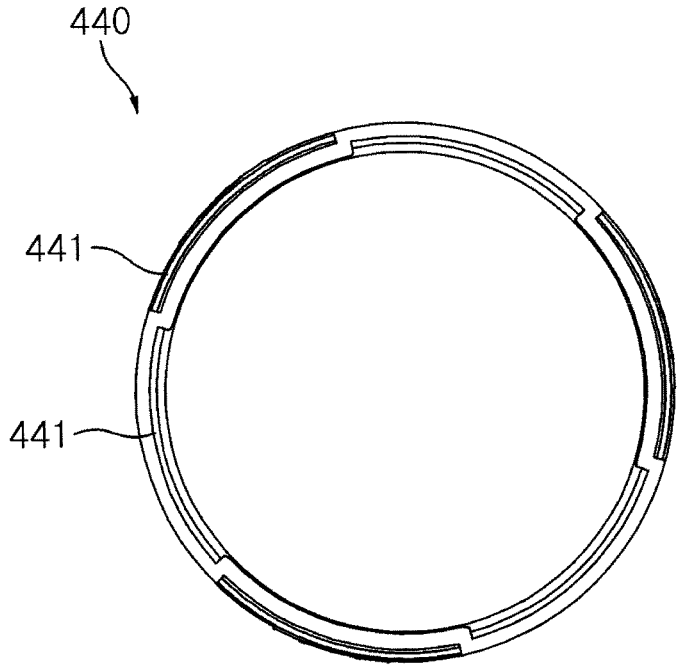

The housing unit 400 covers the light emitting device 100, the power unit module 200 and the support unit 300 and protects them. As shown in FIGS. 4 through 6, the housing unit 400 may include a body 410 having a space 411 accommodating the light emitting device 100, the power unit module 200 and the support unit 300 therein through the open lower edge thereof, and a reflective surface 420 extending downwardly from an upper edge of the body 410 towards the space 411 and having an opening 421 allowing the light emitting device 100 to be exposed. The body 410 and the reflective surface 420 may be integrally formed. The diffusion plate 430 and the covering portion 440 fixing the diffusion plate 430 to the body 410 are disposed on the upper edge of the body 410.

The housing unit 400 has the diffusion plate 430 disposed on the upper edge of the body 410, thereby protecting the light emitting device 100 from the external environment and improving light emission efficiency by allowing light emitted from the light emitting device 100 to be radiated to a wide area. The diffusion plate 430 may be fixed to the upper edge of the body 410 using the covering portion 440 coupled thereto.

The covering portion 440 may include a plurality of coupling protrusions 441 on an upper surface thereof as shown in FIG. 5. Particularly, part of the plurality of coupling protrusions 441 may be formed along an inner circumferential surface of the covering portion 440 to be spaced apart from adjacent coupling protrusions by a predetermined distance, and the other part thereof may be formed along an outer circumferential surface of the covering portion 440 to be spaced apart from adjacent coupling protrusions by a predetermined distance. The individual coupling protrusions formed along the outer circumferential surface of the covering portion 440 may alternate with the individual coupling protrusions formed along the inner circumferential surface of the covering portion 440 to be arranged in a series of zigzags.

Figure 6A:
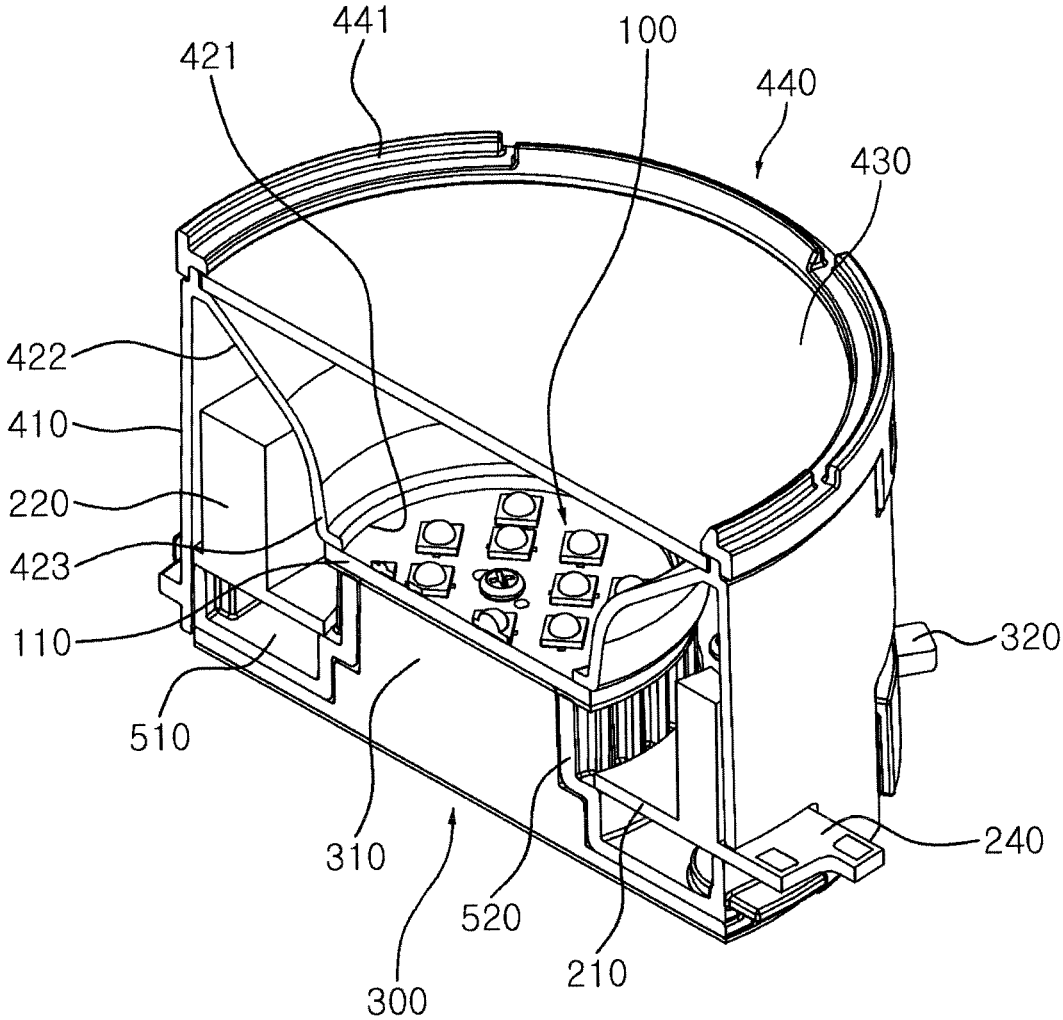
FIGS. 6A and 6B are a cut-away perspective view and a cross-sectional view of the light source for an illumination apparatus of FIG. 1.
Figure 6B:
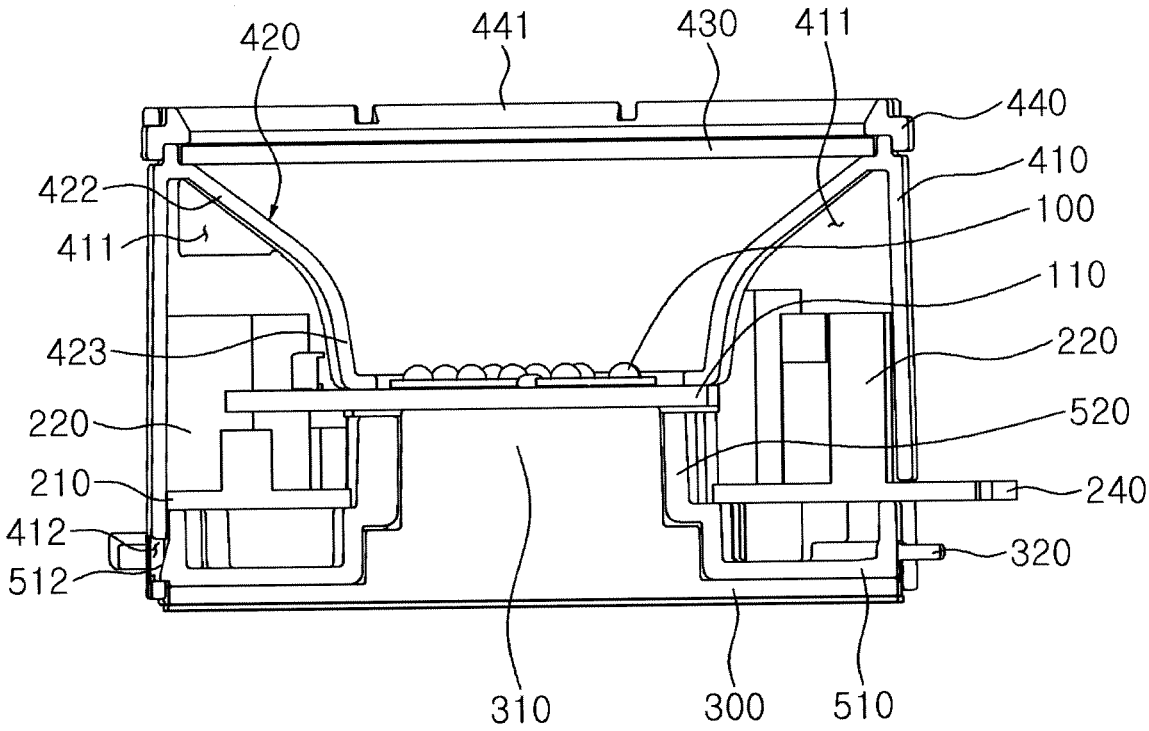

Meanwhile, as shown in FIGS. 6A and 6B, the body 410 accommodates the assembly including the power unit module 200, the insulating adapter 500 and the light emitting device 100 stacked on the support unit 300 in the space 411 between the body 410 and the reflective surface 420 through the open lower edge thereof. A plurality of coupling slots 412 are formed about the circumference of the lower portion of the body 410 and fixing protrusions 512 formed on an outer side surface of the accommodating portion 510 of the insulating adapter 500 are fixedly inserted into the coupling slots 412, thereby preventing the assembly accommodated within the space 411 from falling out of the body 410. Indentations 413 are formed about the circumference of the lower edge of the body 410 in positions corresponding to the positions of the terminal portion 240 of the power unit module 200 and the protruding portions 320 of the support unit 300 to thereby allow the terminal portion 240 and the protruding portions 320 to protrude outwardly from the outer side surface of the body 410. In this case, the terminal portion 240, when protruding from the outer side surface of the body 410, may have a predetermined height with relation to the lower edge of the body 410 as shown in FIG. 6.

Figure 7:
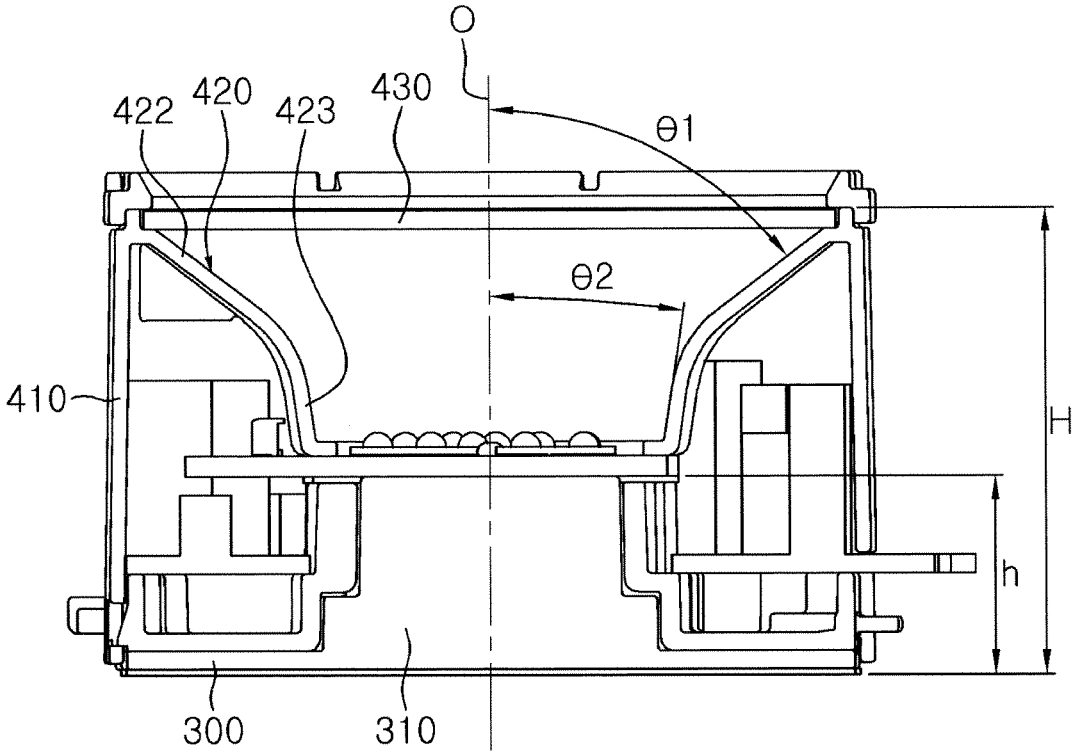
FIG. 7 is a schematic cross-sectional view illustrating the structure of a support unit and a reflective surface of a housing unit in the light source for an illumination apparatus of FIG. 1.

The light emitting device 100 is disposed in the opening 421 formed in an edge of the reflective surface 420 to be exposed outwardly. The reflective surface 420 is bent to avoid interference with the electronic devices 220 of the power unit module 200. Particularly, the reflective surface 420 may, as shown in FIG. 7, have a multi-surface structure including a first surface 422 slantly extending from the upper edge of the body 410 to be downwardly inclined at a first angle of inclination $\theta 1$ with relation to an optical axis O perpendicular to the light emitting device 100, and a second surface 423 slantly extending from an edge of the first surface 422 to be bent at a second angle of inclination $\theta 2$ with relation to the optical axis O. The opening 421 is formed in an edge of the second surface 423.

The first angle of inclination $\theta 1$, with relation to the optical axis O, may be in a range of approximately 47° to 70°, and the second angle of inclination $\theta 2$, with relation to the optical axis O, may be in a range of approximately 1° to 62°. The second angle of inclination $\theta 2$ may have a slope equal to or less than that of the first angle of inclination θ1. In this case, a ratio of the first angle of inclination θ1 to the second angle of inclination θ2 may be in a range of 1 to 70. That is, in a case in which the second angle of inclination θ2 is 1°, the first angle of inclination θ1 may have a slope between 47° and 70°. In a case in which the second angle of inclination θ2 is 62°, the first angle of inclination θ1 may have a slope between 62° and 70°. The angle of inclination should be 1° or greater, since a slope is required for an injection molding of the reflective surface, and when the angle of inclination is 70° or less, the effect of light reflection may be achieved.

The angles of inclination θ1 and θ2 may be varied in consideration of the height h of the mounting portion 310 of the support unit 300, so long as the first and second surfaces 422 and 423 are disposed to avoid interference with the power unit module 200 disposed within the space 411. The first and second surfaces 422 and 423 may be coated with a high reflective material for improving light output.

Meanwhile, as shown in FIG. 7, in order to improve light output, the first and second surfaces 422 and 423 of the reflective surface 420 have slopes within the ranges of the first and second angles of inclination θ1 and θ2, respectively, while the height h of the mounting portion 310 may be in a range of ⅓ to ⅗ of the height H of the housing unit 400. Specifically, the mounting portion 310 may be disposed to have a height allowing the light emitting device 100 mounted on the upper surface of the mounting portion 310 to correspond to ⅓ to ⅗ of the height H of the housing unit 400, i.e., the height from the housing unit 400 to the diffusion plate 430 emitting light, with relation to the lower edge of the housing unit 400. In a case in which the mounting portion 310 is disposed to have a height h equal to or greater than ⅗ of the total height H with relation to the lower edge of the housing unit 400, the light emitting device 100 is close to an upper surface of the housing unit 400. In this case, light emission efficiency is improved, but the formation of hot spots and a reduction of thermal emission efficiency may be caused. On the contrary, in a case in which the mounting portion 310 is disposed to have a height h equal to or less than ⅓ of the total height H with relation to the lower edge of the housing unit 400, thermal emission efficiency may be increased, while light emission efficiency may be reduced. The ranges of the first and second angles of inclination θ1 and θ2 as described above may be referred to as the slopes of the first and second surfaces in the case in which the mounting portion is disposed to have a height corresponding to ⅓ of the total height with relation to the lower edge of the housing unit. This is merely an exemplary embodiment of the invention; however, the invention is not limited thereto.

Figure 8:
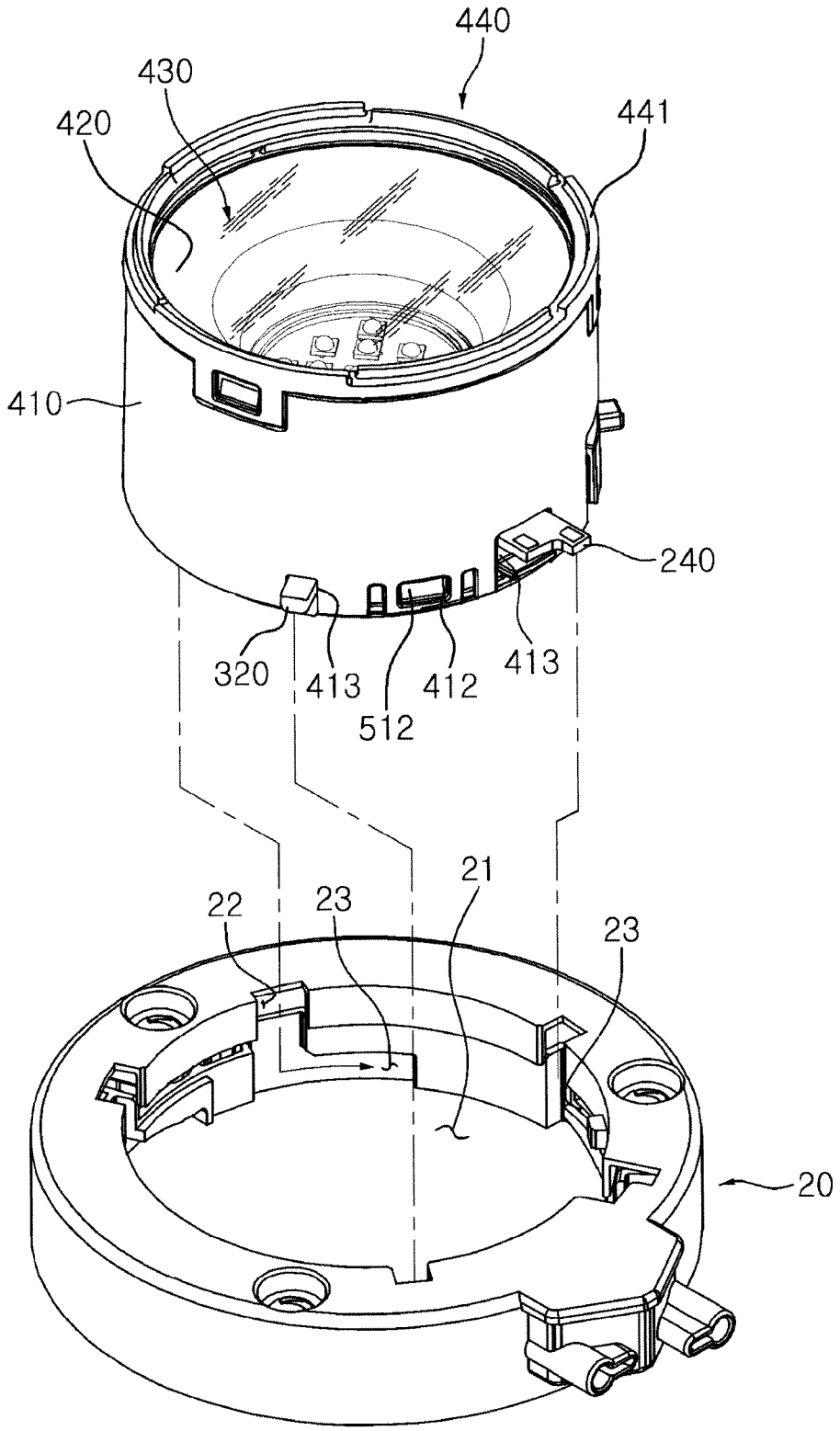
FIG. 8 is a schematic view of an illumination apparatus having a coupling structure of a light source and a socket, according to an embodiment of the present invention.
Figure 9:
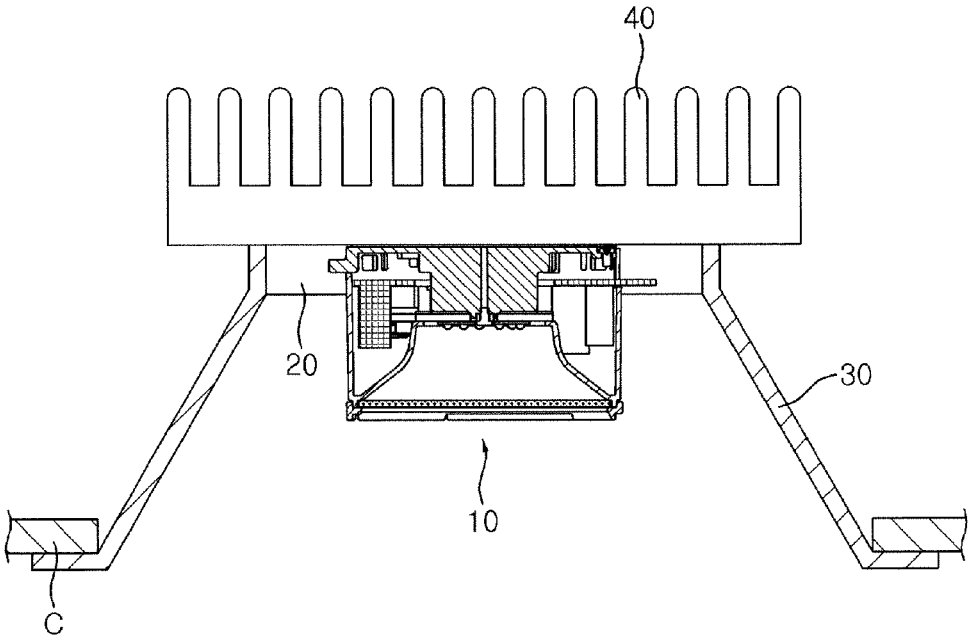
FIG. 9 is a schematic cross-sectional view of the illumination apparatus of FIG. 8, in which the light source and the socket are coupled.

Meanwhile, the light source 10 for an illumination apparatus may further include a socket 20 for the fixation of the light source 10 as shown in FIG. 8, and a reflective shade 30 provided about the circumference of the housing unit 400 of the light source 10 and a heat sink 40 discharging heat generated by the light emitting device 100 and the power unit module 200 to the outside as shown in FIG. 9.

The socket 20 supports the light source 10 to be fixedly coupled thereto and supplies electrical signals from the outside to the light source 10. The socket 20 includes a coupling hole 21 to which the housing unit 400 of the light source 10 is inserted and detachably coupled. In the coupling hole 21, guide grooves 22 are provided in positions corresponding to those of the terminal portion 240 and the protruding portions 320 outwardly protruding from the outer side surface of the housing unit 400 of the light source 10. Specifically, the guide grooves 22 extend from an upper edge of the coupling hole 21 towards a lower edge thereof in the corresponding positions to those of the terminal portion 240 and the protruding portions 320. Fixing grooves 23 are formed along an inner circumferential surface of the coupling hole 21 to be connected to the guide grooves 22. Accordingly, when the light source 10 is coupled to the coupling hole 21, the terminal portion 240 and the protruding portions 320 of the light source 10 are inserted into the respective guide grooves 22. When the light source 10 is rotated in a state in which the terminal portion 240 and the protruding portions 320 are inserted into the respective guide grooves 22, the terminal portion 240 and the protruding portions 320 are moved to the fixing grooves 23 connected to the guide grooves 22 and fixed thereto. In this case, the terminal portion 240 is electrically connected to an electrode terminal (not shown) provided in the fixing groove 23 so that an electric current is applied between the light source 10 and the socket 20.

The socket 20 may be fixed to a fixture C such as a wall or a ceiling using a fixing member such as a screw or the like. The reflective shade 30 may be provided about the circumference of the housing unit 400 of the light source 10 coupled to the socket 20 to thereby control light extraction efficiency and the orientation angle of light. The heat sink 40 may be provided on a lower surface of the socket 20 (depicted as an upper surface in FIG. 9) coupled to the light source 10 in a direction opposite to the reflective shade 30 to thereby discharge heat generated by the light emitting device 100 and the power unit module 200 to the outside and thus improve thermal emission efficiency.

Figure 10:
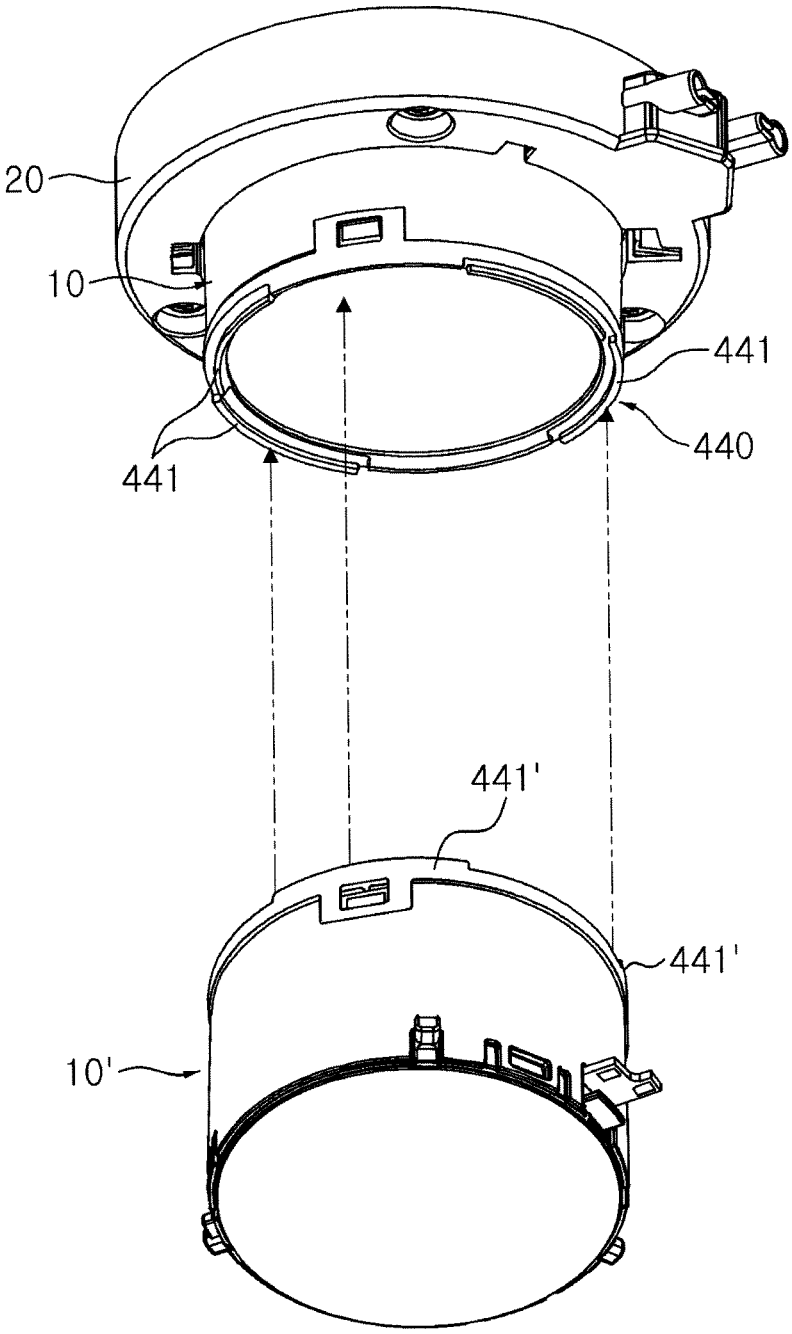
FIG. 10 is a schematic view illustrating a method of replacing the light source in the illumination apparatus of FIG. 9.

The light source 10 fixedly coupled to the socket 20 needs to be installed in and separated from the socket 20 with ease for the facilitation of the replacement thereof. To this end, the light source 10 has the coupling protrusions 441 provided on the covering unit 440 engaged with coupling protrusions 441' provided on a covering unit 440' of another light source 10'. That is, as shown in FIG. 10, in a case in which the light source 10 is separated from the socket 20 within the reflective shade 30 for the replacement thereof, the coupling protrusions 441 and 441' are engaged with each other in a state in which the covering unit 440' of the new light source 10' contacts the covering unit 440 of the light source 10 to be replaced, and the new light source 10' is rotated. At this time, the light source 10 engaged with the light source 10' is also rotated due to the rotation of the light source 10' and thus it can be separated from the socket 20.

The light source 10 is detachably coupled to the socket 20 such that it may be easily separated therefrom and replaced with a new one in a case in which the light emitting device is defective or the like, whereby repairs and maintenance can be facilitated.

Figure 11:
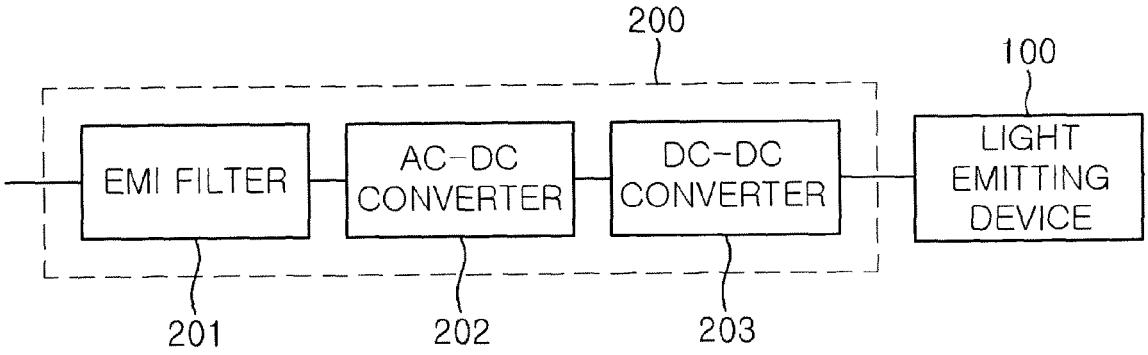
FIG. 11 is a block diagram of a power unit module provided in a light source for an illumination apparatus according to an embodiment of the present invention.

FIG. 11 is a block diagram of a power unit module provided in a light source for an illumination apparatus according to an embodiment of the present invention. With reference to FIG. 11, the power unit module 200 according to this embodiment may include the EMI filter 201, the AC-DC converter 202 and the DC-DC converter 203. The power unit module 200 may be supplied with commercial AC power from the outside to thereby drive the light emitting device 100. FIG. 11 shows that the EMI filter 201 and the AC-DC converter 202 are included in the power unit module 200; however, it would be obvious to a person skilled in the art that the EMI filter 201 and the AC-DC converter 202 could be provided as separate devices outside of the power unit module 200. That is, the power unit module 200 may receive DC power converted externally thereto and allow it to be converted into a DC voltage suitable for the driving of the light emitting device 100.

The EMI filter 201, an Electro Magnetic Interference filter, is disposed between an external AC power source and the AC-DC converter 202 such that the EMI filter 201 may prevent interference of an AC input line from flowing to the AC-DC converter 202 while preventing switching interference generated in the AC-DC converter 202 or the DC-DC converter 203 from flowing to the AC input line and blocking electromagnetic waves detrimental to a human body.

The AC-DC converter 202 converts AC power inputted through the EMI filter 201 into DC power, and the DC power converted in the AC-DC converter 202 is inputted to the DC-DC converter 203 so as to be converted into a driving voltage suitable for the driving of the light emitting device 100. The AC-DC converter 202 connected to the external AC power source may be supplied with external voltage to provide full-wave rectification and include a plurality of diodes. Here, the plurality of diodes may have a half-bridge structure or a full-bridge structure.

The DC voltage rectified in the AC-DC converter 202 is inputted to the DC-DC converter 203 receiving the DC voltage inputted through the AC-DC converter 202 and converting the input voltage into DC voltage suitable for the driving of the light emitting device 100. Here, the selection and interconnection of the DC-DC converter 203 may be determined depending on whether the input voltage to be converted is higher or lower than a voltage required to drive the LED with a desired operating current, or whether the input voltage changes from a high voltage to a low voltage. For example, a buck converter used when the input voltage is higher than the LED voltage, a boost converter used when the input voltage is lower than the LED voltage, a buck-boost converter used when the input voltage is changeable from a voltage higher than the LED voltage to a voltage lower than the LED voltage, or the like may be used therefor.

Meanwhile, a power factor correction (PFC) flyback converter may be used as an LED driving circuit allowing for power factor correction at a relatively low cost. However, such a flyback converter requires a photo coupler transferring current information of the light emitting device from a secondary side to a primary side and a transformer supplying power from the primary side to the secondary side. In this case, it is difficult to miniaturize the circuit. In order to minimize the size of the power unit module, a non-isolation type converter (for example, a buck converter, a boost converter, or a buck-boost converter) may be adopted; however, the invention is not limited thereto.

Figure 12:
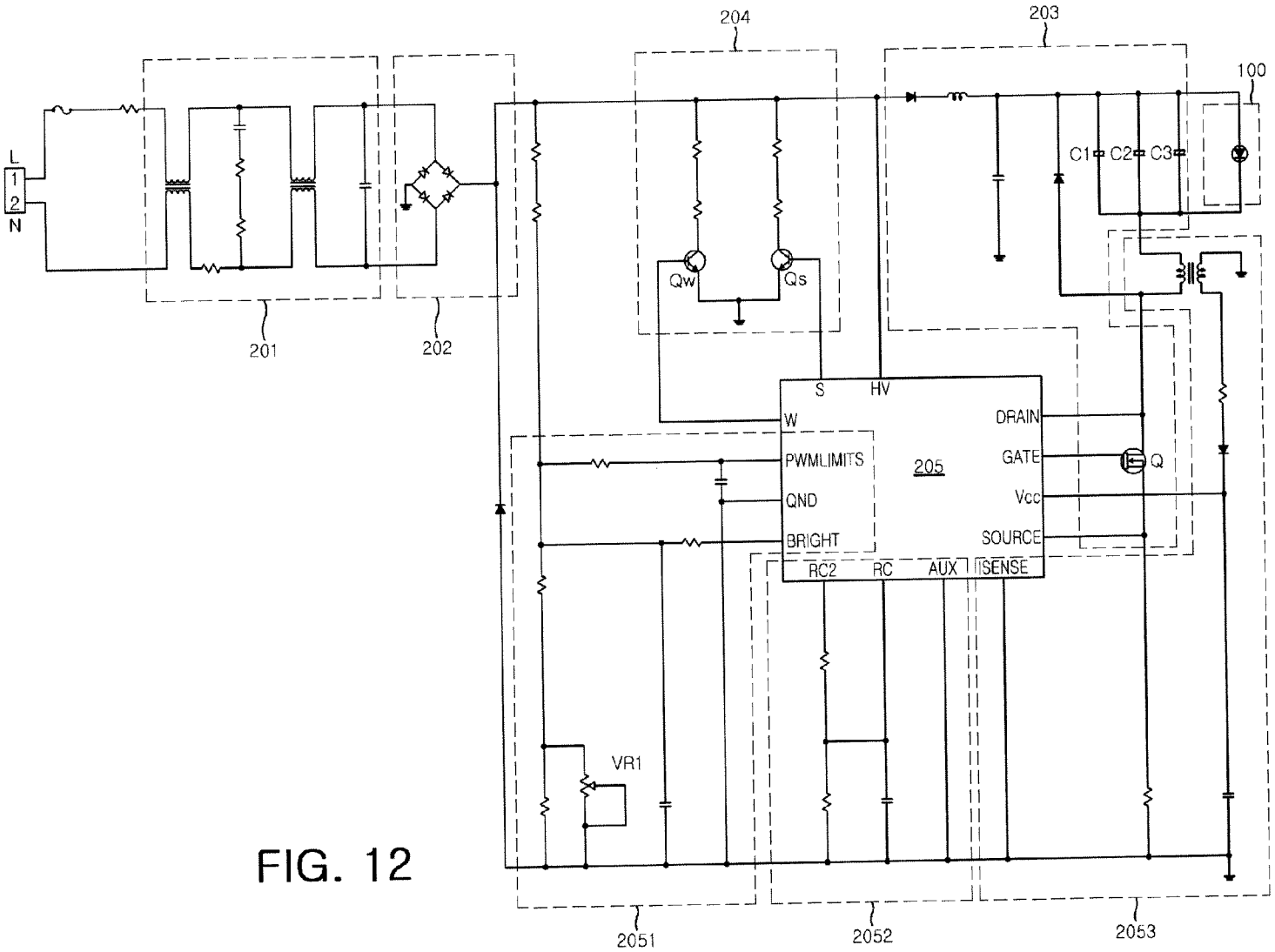
FIG. 12 is a driving circuit diagram of a power unit module provided in a light source for an illumination apparatus according to another embodiment of the present invention.

FIG. 12 is a driving circuit diagram of a power unit module provided in a light source for an illumination apparatus according to another embodiment of the present invention. With reference to FIG. 12, the power unit module 200 according to this embodiment includes the EMI filter 201 having an end connected to an external power source, the AC-DC converter 202 connected to the other end of the EMI filter 201 and converting AC power into DC power through full-wave rectification, the DC-DC converter 203 converting the DC power outputted from the AC-DC converter 202 into DC power suitable for driving the light emitting device 100, and a controller 205 controlling current inputted to the light emitting device 100.

The same reference numerals will be used to designate the same elements as those described in the previous embodiment, and a detailed description of newly added elements will be provided below. As shown in FIG. 12, the AC-DC converter 202 may include four diodes having a full-bridge structure, and the controller 205 controlling the current supplied to the light emitting device 100 and a dimming circuit 204 connected to the controller 205 are provided. The controller 205 may be connected to a protection circuit 2051, a frequency setting circuit 2052 and a current feedback circuit 2053, and control the current supplied to the light emitting device 100 using a switch Q connected to a terminal of the controller 205.

Specifically, the current flowing through the light emitting device 100 is fed-back to the controller 205 through the current feedback circuit 2053, and the controller 205 causes the frequency setting circuit 2052 to set a switching frequency of the switch Q connected to the DC-DC converter 203 using a level of the fed-back current. In the protection circuit 2051 connected to the controller 205, a duty limit of the switch Q is set using the level of the fed-back current, whereby damages to a circuit device caused by overcurrent may be prevented. The protection circuit 2051 may include a variable resistor VR1 and finely adjust a voltage value detected therefrom using the variable resistor VR1.

Meanwhile, as shown in FIG. 12, the dimming circuit 204 connected to a plurality of terminals S and W of the controller 205 may be further included to control the dimming of the light emitting device 100. The dimming circuit 204 is used to adjust the brightness of light emitting elements 120 forming the light emitting device 100. The dimming circuit 204 may include two switches Qw and Qs connected to the terminals S and W of the controller 205. The terminal W of the controller 205 may constantly maintain an operating current of a dimmer using the switch Qw connected to the terminal W. The terminal S of the controller 205 may maintain the current of the dimmer using the switch Qs connected to the terminal S when the dimming circuit is off.

For example, a triac dimmer may be applied to the present embodiment. The triac dimmer controls current supply to set a level of illumination desired by a user. In a case in which a light source for an existing illumination apparatus is replaced with an LED, the circuit may not be properly driven or flickering may occur due to the operational characteristics of the triac dimmer, leading to difficulties in replacing the light source for the illumination apparatus, having an existing triac dimmer connected thereto, with an LED. However, in the present embodiment, the two switches Qs and Qw connected to the controller 205 are included to control the current of the dimmer, thereby achieving compatibility with the existing triac dimmer.

The DC-DC converter 203 may include at least one capacitor connected in parallel with the light emitting device 100. Specifically, as shown in FIG. 12, the DC-DC converter 203 may include first, second and third capacitors C1, C2 and C3 connected in parallel with the light emitting device 100. The first, second and third capacitors C1, C2 and C3 may cause the current inputted to the light emitting device 100 to be smoothed, thereby reducing ripple current in the light emitting device 100.

Hereinafter, a method of manufacturing a light source for an illumination apparatus according to an embodiment of the present invention will be described.

As shown in FIG. 2, the power unit module 200 is prepared, the power unit module 200 having the electronic devices 220 provided on the circuit board 210 having the through hole 230. In addition, the insulating adapter 500 is prepared, the insulating adapter 500 including the accommodating portion 510 having the accommodating groove 511, into which the circuit board 210 is placed, and the insertion portion 520 protruding upwardly of the accommodating portion 510 and having the insertion hole 521. Furthermore, the support unit 300 is prepared, the support unit 300 having the mounting portion 310 inserted into the insertion hole 521.

Next, as shown in FIG. 3, the mounting portion 310 inserted into the insertion hole 521, together with the insertion portion 520, is assembled to be protruded upwardly of the circuit board 210 through the through hole 230. That is, the insulating adapter 500 and the support unit 300 are assembled with the power unit module 200 to thereby form an assembly.

The light emitting device 100 is mounted on the mounting portion 310 while being disposed above the circuit board 210 to be spaced apart therefrom.

Next, as shown in FIG. 4, the housing unit 400 is prepared, the housing unit 400 including the body 410 having the space 411 accommodating the assembly, in which the power unit module 200, the insulating adapter 500 and the support unit 300 having the light emitting device 100 mounted thereon are assembled, therein and the reflective surface 420 disposed within the space 411. The assembly is accommodated within the space 411 to be coupled thereto through the open lower edge of the body 410.

In this case, the mounting portion 310 is disposed to have the height h corresponding to ⅓ to ⅗ of the height H of the housing unit 400 with relation to the lower edge thereof.

The reflective surface 420 may have the first surface 422 slantly extending from the upper edge of the body 410 to be inclined at the first angle of inclination θ1 with relation to the optical axis O, and the second surface 423 slantly extending from the edge of the first surface 422 to be bent at the second angle of inclination θ2 with relation to the optical axis O.

In particular, the first angle of inclination θ1 with v to the optical axis O may be in a range of 47° to 70°, and the second angle of inclination θ2 with relation to the optical axis O may be in a range of 1° to 62°. In this case, a ratio of the first angle of inclination θ1 to the second angle of inclination θ2 may be in a range of 1 to 70. That is, in a case in which the second angle of inclination θ2 is 1°, the first angle of inclination θ1 may have a slope between 47° and 70°. In a case in which the second angle of inclination θ2 is 62°, the first angle of inclination θ1 may have a slope between 62° and 70°. The ranges of the angles of inclination θ1 and θ2 may be varied in consideration of the height h of the mounting portion 310 of the support unit 300 in order that the first and second surfaces 422 and 423 be disposed to avoid interference with the power unit module 200 disposed within the space 411.

As set forth above, in a light source for an illumination apparatus according to embodiments of the invention, thermal emission efficiency and light emission efficiency can be improved, and life span and product reliability can also be improved.

The replacement of a light source for an illumination apparatus is facilitated, whereby repairs and maintenance can be facilitated.

While the present invention has been shown and described in connection with the embodiments, it will be apparent to those skilled in the art that modifications and variations can be made without departing from the spirit and scope of the invention as defined by the appended claims.

What is claimed is:

1. A light source for an illumination apparatus, the light source comprising:

a light emitting device;

a power unit module supplying an electrical signal to the light emitting device;

a support unit having the light emitting device thereon and discharging heat generated by the light emitting device to the outside; and a housing unit covering and protecting the light emitting device, the power unit module and the support unit, wherein the light emitting device is disposed to have a height greater than that of a contact region between the power unit module and the housing unit with relation to a lower edge of the housing unit, wherein:

the power unit module includes:

a circuit board; and electronic devices mounted on the circuit board, the circuit board has a through hole in a central portion thereof, and the support unit includes a mounting portion having the light emitting device mounted thereon and disposed to protrude upwardly of the circuit board through the through hole such that the height of the light emitting device is adjustable with relation to the lower edge of the housing unit.

2. The light source of claim 1, wherein the power unit module includes a terminal portion provided on an outer circumferential surface of the circuit board to be supplied with an electrical signal, wherein the terminal portion protrudes outwardly of the housing unit.

3. The light source of claim 1, wherein the electronic devices are disposed about a circumference of the through hole.

4. The light source of claim 1, wherein the support unit supports the light emitting device mounted on the mounting portion to be disposed in a central portion of the power unit module.

5. The light source of claim 1, wherein the mounting portion is disposed to have a height in a range of ⅓ to ⅗ of a height of the housing unit with relation to the lower edge of the housing unit.

6. The light source of claim 1, wherein the support unit includes a plurality of protruding portions provided along an outer circumferential surface thereof, wherein the plurality of protruding portions protrude outwardly of the housing unit.

7. The light source of claim 1, further comprising an insulating adapter disposed between the power unit module and the support unit.

8. The light source of claim 7, wherein the insulating adapter includes:

an accommodating portion including an accommodating groove having the circuit board placed therein; and an insertion portion disposed in a central portion of the accommodating portion to protrude upwardly of the circuit board through the through hole and including an insertion hole having the support unit inserted thereinto.

9. The light source of claim 1, wherein the housing unit includes:

a body having a space accommodating the light emitting device, the power unit module and the support unit therein; and a reflective surface extending from an upper edge of the body towards the space and providing an opening allowing the light emitting device to be exposed.

10. The light source of claim 9, wherein the reflective surface includes:

a first surface slantly extending from the upper edge of the body to be inclined at a first angle of inclination with relation to an optical axis perpendicular to the light emitting device; and a second surface slantly extending from an edge of the first surface to be bent at a second angle of inclination with relation to the optical axis.

11. The light source of claim 10, wherein the first angle of inclination with relation to the optical axis is in a range of 47° to 70°, and the second angle of inclination with relation to the optical axis is in a range of 1° to 62 °.

12. The light source of claim 10, wherein a ratio of the first angle of inclination to the second angle of inclination is in a range of 1 to 70.

13. The light source of claim 9, wherein the housing unit further includes:

a diffusion plate mounted on the upper edge of the body; and a covering portion fixing the diffusion plate.

14. The light source of claim 13, wherein the covering portion has a plurality of coupling protrusions on an upper surface thereof.

15. The light source of claim 14, wherein the plurality of coupling protrusions include:

part of the plurality of coupling protrusions disposed along an inner circumferential surface of the covering portion to be spaced apart from adjacent coupling protrusions; and the other part thereof disposed along an outer circumferential surface of the covering portion to be spaced apart from adjacent coupling protrusions, wherein the individual coupling protrusions disposed along the outer circumferential surface of the covering portion alternate with the individual coupling protrusions disposed along the inner circumferential surface of the covering portion to be arranged in a series of zigzags.

16. The light source of claim 1, further comprising a socket having a coupling hole detachably coupled with the housing unit inserted therein and supplying the electrical signal from the outside to the light emitting device.

17. The light source of claim 16, wherein the socket includes:

guide grooves extending from an upper edge of the coupling hole towards a lower edge thereof; and fixing grooves connected to the guide grooves and provided along an inner circumferential surface of the coupling hole.

18. The light source of claim 1, further comprising a reflective shade provided about a circumference of the housing unit.

19. The light source of claim 1, further comprising a heat sink discharging heat generated by the light emitting device and the power unit module to the outside.

20. A light source for an illumination apparatus, the light source comprising:

a light emitting device mounted on a board;

a power unit module supplying an electrical signal to the light emitting device;

a support unit having the light emitting device thereon and discharging heat generated by the light emitting device to the outside; and a housing unit covering and protecting the light emitting device, the power unit module and the support unit, wherein the board is separated and spaced apart from a circuit board of the power unit module to be disposed above the circuit board, wherein:

the power unit module includes electronic devices mounted on the circuit board, wherein the circuit board has a through hole in a central portion thereof, and the support unit includes a mounting portion having the light emitting device mounted thereon and disposed to protrude upwardly of the circuit board through the through hole such that a height of the light emitting device is adjustable with relation to a lower edge of the housing unit.

21. The light source of claim 20, wherein the mounting portion is disposed to have a height in a range of ⅓ to ⅗ of a height of the housing unit with relation to the lower edge of the housing unit.

22. The light source of claim 20, wherein the housing unit includes:

a body having a space accommodating the light emitting device, the power unit module and the support unit therein; and a reflective surface extending from an upper edge of the body towards the space and providing an opening allowing the light emitting device to be exposed.

23. The light source of claim 22, wherein the reflective surface includes:

a first surface slantly extending from the upper edge of the body to be inclined at a first angle of inclination with relation to an optical axis perpendicular to the light emitting device; and a second surface slantly extending from an edge of the first surface to be bent at a second angle of inclination with relation to the optical axis.

24. The light source of claim 23, wherein the first angle of inclination with relation to the optical axis is in a range of 47° to 70°, and the second angle of inclination with relation to the optical axis is in a range of 1° to 62 °.

25. The light source of claim 23, wherein a ratio of the first angle of inclination to the second angle of inclination is in a range of 1 to 70.

* * * * *